US008645141B2

(12) United States Patent
Wong et al.

(10) Patent No.: US 8,645,141 B2
(45) Date of Patent: Feb. 4, 2014

(54) METHOD AND SYSTEM FOR TEXT TO SPEECH CONVERSION

(75) Inventors: Ling Jun Wong, Escondido, CA (US); True Xiong, San Diego, CA (US)

(73) Assignee: Sony Corporation, Tokyo (JP)

( * ) Notice: Subject to any disclaimer, the term of this patent is extended or adjusted under 35 U.S.C. 154(b) by 116 days.

(21) Appl. No.: 12/881,979

(22) Filed: Sep. 14, 2010

(65) Prior Publication Data

US 2012/0065979 A1 Mar. 15, 2012

(51) Int. Cl.
*G10L 13/00* (2006.01)

(52) U.S. Cl.
USPC ..... 704/260; 704/258; 704/270; 704/271

(58) Field of Classification Search
USPC ..... 704/270, 258–269, 271
See application file for complete search history.

(56) References Cited

U.S. PATENT DOCUMENTS

| | | | | |
|---|---|---|---|---|
| 6,600,814 | B1 * | 7/2003 | Carter et al. | 379/88.16 |
| 6,810,379 | B1 * | 10/2004 | Vermeulen et al. | 704/260 |
| 6,886,036 | B1 | 4/2005 | Santamaki et al. | |
| 7,043,432 | B2 * | 5/2006 | Bakis et al. | 704/260 |
| 7,457,915 | B2 * | 11/2008 | Getzinger | 711/113 |
| 7,469,208 | B1 * | 12/2008 | Kincaid | 704/224 |
| 7,490,775 | B2 * | 2/2009 | Biderman | 235/472.01 |
| 8,073,695 | B1 * | 12/2011 | Hendricks et al. | 704/260 |
| 2004/0133908 | A1 * | 7/2004 | Smith et al. | 725/31 |
| 2005/0071167 | A1 | 3/2005 | Levin et al. | |
| 2007/0150456 | A1 * | 6/2007 | Lian et al. | 707/3 |
| 2007/0220552 | A1 * | 9/2007 | Juster et al. | 725/46 |
| 2007/0276667 | A1 * | 11/2007 | Atkin et al. | 704/260 |
| 2008/0139112 | A1 * | 6/2008 | Sampath et al. | 455/3.04 |
| 2008/0155129 | A1 * | 6/2008 | Khedouri et al. | 710/8 |
| 2008/0189099 | A1 * | 8/2008 | Friedman et al. | 704/8 |
| 2008/0294443 | A1 | 11/2008 | Eide | |
| 2008/0306909 | A1 * | 12/2008 | Bernard et al. | 707/3 |
| 2009/0276064 | A1 | 11/2009 | Van Gassel | |
| 2010/0070281 | A1 | 3/2010 | Conkie et al. | |
| 2010/0082328 | A1 * | 4/2010 | Rogers et al. | 704/8 |
| 2010/0082346 | A1 | 4/2010 | Rogers et al. | |
| 2010/0082349 | A1 * | 4/2010 | Bellegarda et al. | 704/260 |
| 2010/0088746 | A1 | 4/2010 | Kota et al. | |
| 2012/0023095 | A1 * | 1/2012 | Wadycki et al. | 707/723 |

* cited by examiner

*Primary Examiner* — Douglas Godbold
*Assistant Examiner* — Ernest Estes
(74) *Attorney, Agent, or Firm* — John L. Rogitz

(57) ABSTRACT

A system and method for text to speech conversion. The method of performing text to speech conversion on a portable device includes: identifying a portion of text for conversion to speech format, wherein the identifying includes performing a prediction based on information associated with a user. While the portable device is connected to a power source, a text to speech conversion is performed on the portion of text to produce converted speech. The converted speech is stored into a memory device of the portable device. A reader application is executed, wherein a user request is received for narration of the portion of text. During the executing, the converted speech is accessed from the memory device and rendered to the user, responsive to the user request.

11 Claims, 10 Drawing Sheets

METHOD AND SYSTEM FOR TEXT TO SPEECH CONVERSION

FIELD

Embodiments according to the present invention generally relate to text to speech conversion, in particular to text to speech conversion for digital readers.

BACKGROUND

A text-to-audio system can convert input text into an output acoustic signal imitating natural speech. Text-to-audio systems are useful in a wide variety of applications. For example, text-to-audio systems are useful for automated information services, auto-attendants, computer-based instruction, computer systems for the visually impaired, and digital readers.

Some simple text-to-audio systems operate on pure text input and produce corresponding speech output with little or no processing or analysis of the received text. Other more complex text-to-audio systems process received text inputs to determine various semantic and syntactic attributes of the text that influence the pronunciation of the text. In addition, other complex text-to-audio systems process received text inputs with annotations. Annotated text inputs specify pronunciation information used by the text-to-audio system to produce more fluent and human-like speech.

Some text-to-audio systems convert text into high quality, natural sounding speech in near real time. However, producing high quality speech requires a large number of potential acoustic units, complex rules, and exceptions for combining the units. Thus, such systems typically require a large storage capacity and high computational power and typically consume high amounts of power.

Oftentimes, a text-to-audio system will receive the same text input multiple times. Such systems fully process each received text input, converting that text into a speech output. Thus, each received text input is processed to construct a corresponding spoken output, without regard for having previously converted the same text input to speech, and without regard for how often identical text inputs are received by the text-to-audio system.

For example, in the case of digital readers, a single text-to-audio system may receive text input the first time a user listens to a book, and again when the user decides to listen to the book another time. Furthermore, in the case of multiple users, a single book may be converted thousands of times by many different digital readers. Such redundant processing can be energy inefficient, consume processing resources, and waste time.

SUMMARY

Embodiments of the present invention are directed to a method and system for efficient text to speech conversion. In one embodiment, a method of performing text to speech conversion on a portable device includes: identifying a portion of text for conversion to speech format, wherein the identifying includes performing a prediction based on information associated with a user; while the portable device is connected to a power source, performing a text to speech conversion on the portion of text to produce converted speech; storing the converted speech into a memory device of the portable device; executing a reader application wherein a user request is received for narration of the portion of text; and during the executing, accessing the stored converted speech from the memory device and rendering the converted speech to the user responsive to the user request.

In one embodiment, the portion of text includes an audio-converted book. In some embodiments, the information includes identifications of newly added books and the portion of text is taken from the newly added books. In various embodiments, the text includes an audio-converted book, and the performing a prediction includes anticipating a succeeding book based on features of the audio-converted book.

In further embodiments, the information includes a playlist of books. In some embodiments, the playlist of books is user created. In other embodiments, the playlist of books is created by other users with similar attributes to the user.

In another embodiment, a text to speech conversion method includes: identifying a book for conversion to an audio version of the book, wherein the identifying includes performing a prediction based on information associated with the book; while a digital reader is connected to a power source, accessing the audio version of the book; storing the audio version into a memory device of the digital reader; executing a reader application wherein the book is requested for narration by a user; and during the executing, producing an acoustic signal imitating natural speech from the audio version in the memory device of the digital reader.

In some embodiments, the information includes a list of books stored on a server and wherein the list of books includes an identification of the book. In various embodiments, the information includes one of theme, genre, title, author, and date of the book.

In one embodiment, the accessing includes receiving a streaming communication over the internet from a server. In further embodiments, the accessing includes downloading the audio version over the internet from a server. In some embodiments, the accessing includes downloading the audio version over the internet from another digital reader. In various embodiments, the accessing includes downloading directly from another digital reader.

In another embodiment, a text to speech conversion system includes: a processor; a display coupled to the processor, an input device coupled to the processor; an audio output device coupled to the processor; and memory coupled to the processor. The memory includes instructions that when executed cause the system to perform text to speech conversion on a portable device. The method includes: identifying a portion of text for conversion to speech format, wherein the identifying includes performing a prediction based on information associated with a user; while the portable device is connected to a power source, performing a text to speech conversion on the portion of text to produce converted speech; storing the converted speech into a memory device of the portable device; executing a reader application wherein a user request is received for narration of the portion of text; and during the executing, accessing the converted speech from the memory device and rendering the converted speech to the user responsive to the user request.

In some embodiments, the portion of text includes an audio-converted book. In other embodiments, the information includes identifications of newly added books, and the portion of text is taken from the newly added books. In various embodiments, the text includes an audio-converted book, and the performing a prediction includes anticipating a succeeding book based on features of the audio-converted book. In further embodiments, the information includes a user created playlist of books or a playlist of books that is created by other users with similar attributes to the user.

These and other objects and advantages of the various embodiments of the present invention will be recognized by those of ordinary skill in the art after reading the following detailed description of the embodiments that are illustrated in the various drawing figures.

BRIEF DESCRIPTION OF THE DRAWINGS

Embodiments of the present invention are illustrated by way of example, and not by way of limitation, in the figures of the accompanying drawings and in which like reference numerals refer to similar elements.

DETAILED DESCRIPTION

Figure 1:
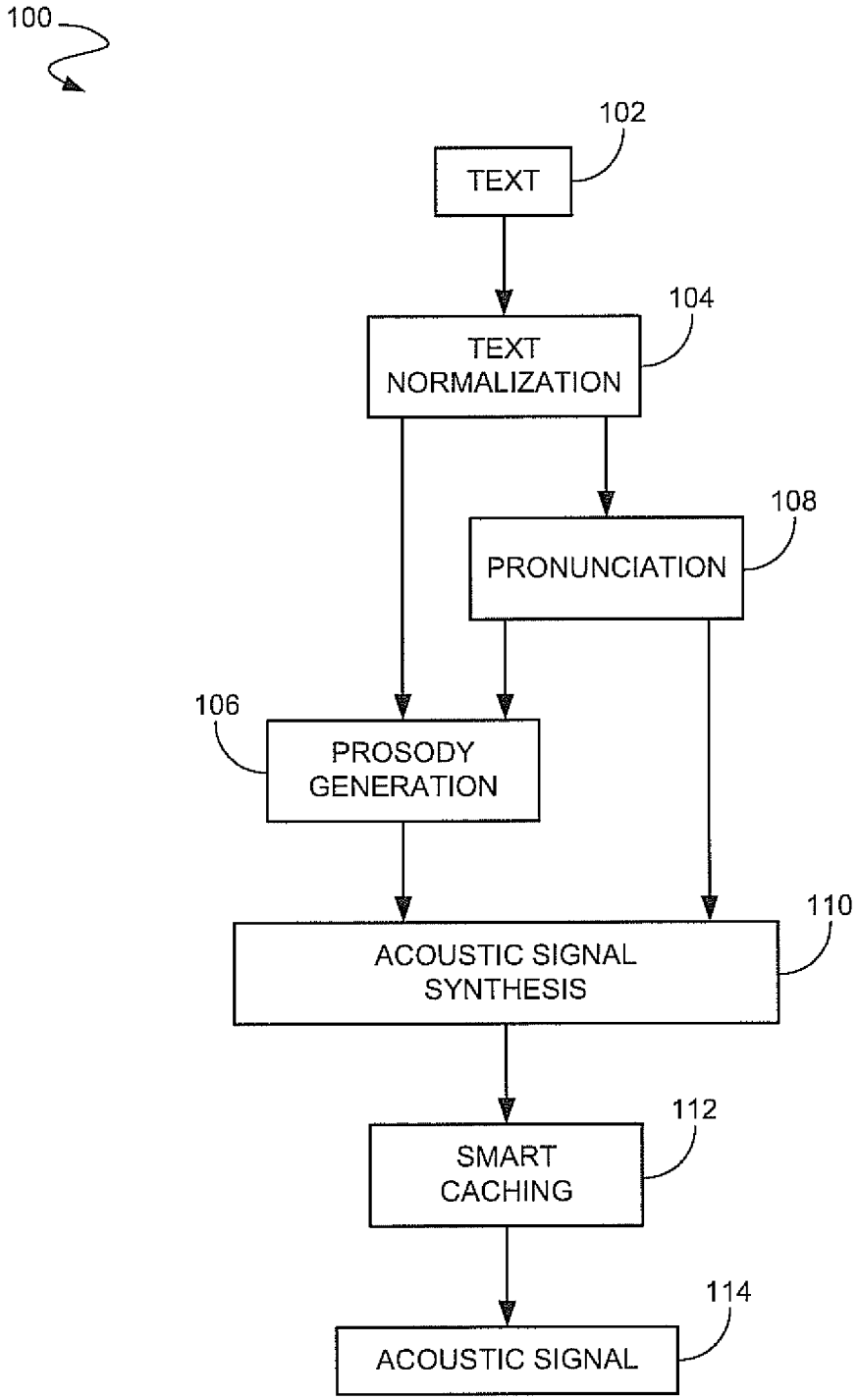
FIG. 1 is a diagram of an exemplary text to speech system, according to an embodiment of the present invention.

Reference will now be made in detail to embodiments in accordance with the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

The drawings showing embodiments of the system are semi-diagrammatic and not to scale and, particularly, some of the dimensions are for the clarity of presentation and are shown exaggerated in the drawing Figures. Also, where multiple embodiments are disclosed and described having some features in common, for clarity and ease of illustration, description, and comprehension thereof, like features one to another will ordinarily be described with like reference numerals.

Some portions (e.g. FIG. 9 and FIG. 10) of the detailed descriptions, which follow, are presented in terms of procedures, steps, simulations, calculations, logic blocks, processing, and other symbolic representations of operations on data within a computer system. These descriptions and representations are the means used by those skilled in the data processing arts to most effectively convey the substance of their work to others skilled in the art. A procedure, computer-executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions refer to the actions and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

FIG. 1 is a diagram of an exemplary text to speech system 100, according to an embodiment of the present invention. The text to speech system 100 converts input text 102 into an acoustic signal 114 that imitates natural speech. The input text 102 usually contains punctuation, abbreviations, acronyms, and non-word symbols. A text normalization unit 104 converts the input text 102 into a normalized text containing a sequence of non-abbreviated words. Most punctuation is useful in suggesting appropriate prosody. Therefore, the text normalization unit 104 filters out punctuation to be used as input to a prosody generation unit 106. In an embodiment, some punctuation is extraneous and is filtered out.

Abbreviations and acronyms are converted to their equivalent word sequences, which may or may not depend on context. The text normalization unit 104 also converts symbols into word sequences. For example, the text normalization unit 104 detects numbers, currency amounts, dates, times, and email addresses. The text normalization unit 104 then converts the symbols to text that depends on the symbol's position in the sentence.

The normalized text is sent to a pronunciation unit 108 that analyzes each world to determine its morphological representation. This is usually not difficult for the English language, however in a language in which words are strung together, e.g. German, words must be divided into base words, prefixes, and suffixes. The resulting words are then converted to a phoneme sequence or its pronunciation.

The pronunciation may depend on a word's position in a sentence or its context, e.g. the surrounding words. In an embodiment, three resources are used by the pronunciation unit 108 to perform conversion: letter-to-sound rules; statistical representations that convert letter sequences into most probable phoneme sequences based on language statistics; and dictionaries that are word and pronunciation pairs.

Conversion can be performed without statistical representations, but all three resources are typically used. Rules can distinguish between different pronunciations of the same word depending on its context. Other rules are used to predict pronunciations of unseen letter combinations based on human knowledge. Dictionaries contain exceptions that cannot be generated from rules or statistical methods. The collection of rules, statistical models, and dictionary forms the database needed for the pronunciation unit 108. In an embodiment, this database is large, particularly for high-quality text to speech conversion.

The resulting phonemes are sent to the prosody generation unit 106, along with punctuation extracted from the text normalization unit 104. The prosody generation unit 106 produces the timing and pitch information needed for speech synthesis from sentence structure, punctuation, specific words, and surrounding sentences of the text. In an example, pitch begins at one level and decreases toward the end of a sentence. The pitch contour can also be varied around this mean trajectory.

Dates, times, and currencies are examples of parts of a sentence that may be identified as special pieces. The pitch of each is determined from a rule set or statistical model that is crafted for that type of information. For example, the final number in a number sequence is usually at a lower pitch than the preceding numbers.

The rhythms, or phoneme durations, for example of a date and a phone number, are typically different from each other. In an embodiment, a rule set or statistical model determines the phoneme durations based on the actual word, its part of the sentence, and the surrounding sentences. These rule sets or statistical models form the database needed for the prosody generation unit 106. In an embodiment, the database may be quite large for more natural sounding synthesizers.

An acoustic signal synthesis unit 110 combines the pitch, duration, and phoneme information from the pronunciation unit 108 and the prosody generation unit 106 to produce the acoustic signal 114 imitating natural speech. The acoustic signal 114 is pre-cached in a smart caching unit 112 in accordance with embodiments of the present invention. The smart caching unit 112 stores the acoustic signal 114 until a user requests to hear the acoustic signal 114 imitating natural speech.

In accordance with embodiments of the present invention, a server-client system may use a variety of smart caching techniques. In an embodiment, recently played audio-converted books may be stored on the server or the client. In some embodiments, newly added books may be pre-converted into audio format. In other embodiments, a list may be ready on a server, which can then stream directly to a client or pre-download to a client. In various embodiments, the client or the server may make smart guesses based on certain features of a book or a user, for example theme, genre, title, author, dates, previously read books, user demographic information, etc. In further embodiments, a playlist of books put together by the user or other users may be pre-cached on the server or the client.

Figure 2:
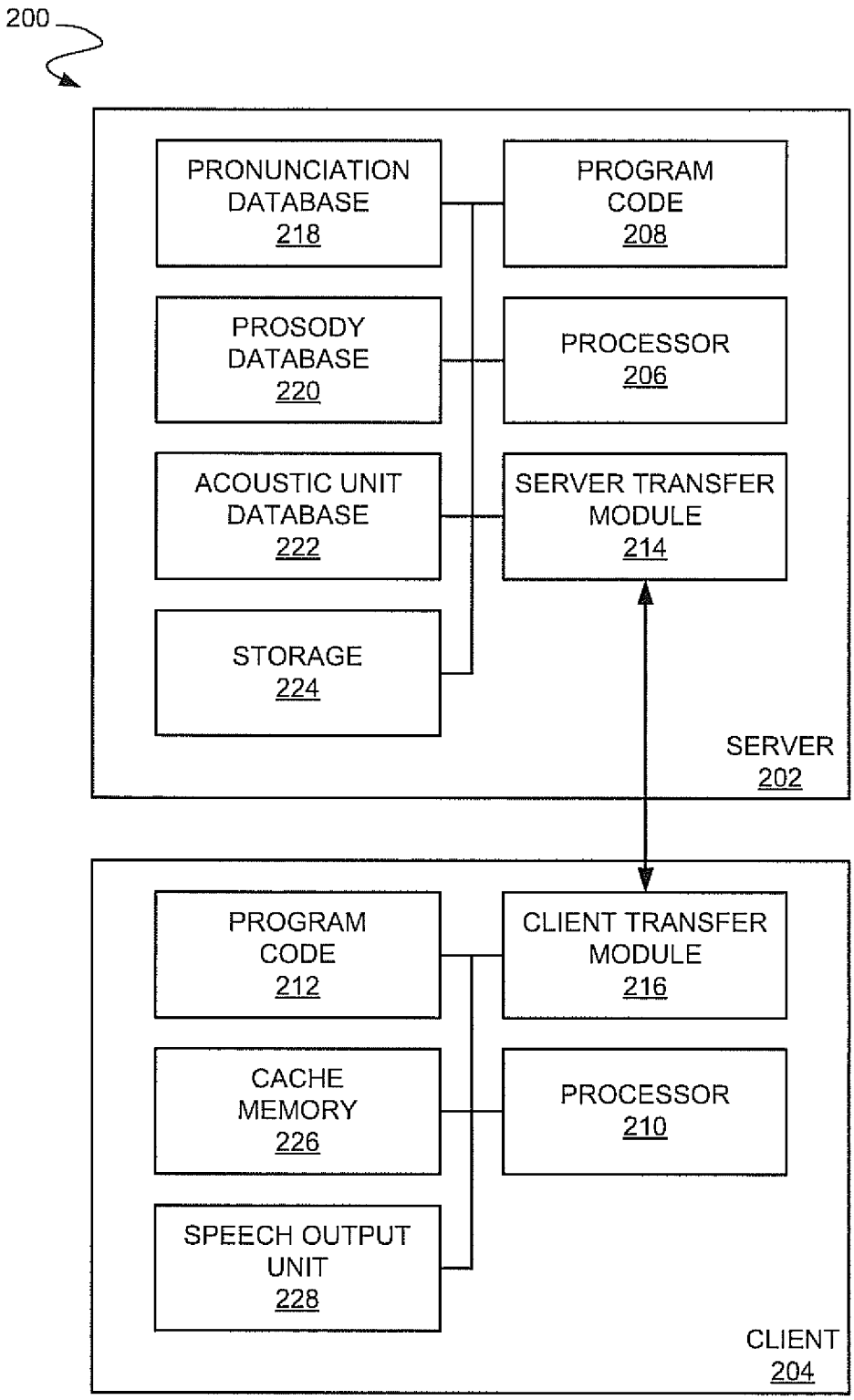
FIG. 2 is a diagram of an exemplary server-client system, according to an embodiment of the present invention.

FIG. 2 is a diagram of an exemplary server-client system 200, according to an embodiment of the present invention. The server-client system 200 converts text into speech on a server machine 202, uses smart caching techniques to prepare the converted text for output, stores the converted text on the server machine 202, and distributes the converted text from the server machine 202 to the client machine 204 for output. In an embodiment, the client machine 204 may be a portable digital reader but could be any portable computer system. The server machine 202 and the client machine 204 may communicate when the client machine 204 is connected to a power source or when the client machine is running on battery power. In an embodiment, the server machine 202 and the client machine 204 communicate by protocols such as XML, HTTP, TCP/IP, etc. The server-client system 200 may include multiple servers and multiple client machines that are connected over the internet or a local area network.

Server processor 206 of the server 202 operates under the direction of server program code 208. Client processor 210 of the client 204 operates under the direction of client program code 212. A server transfer module 214 of the server 202 and a client transfer module 216 of the client 204 communicate with each other. In an embodiment, the server 202 completes all of the steps of the text to speech system 100 (FIG. 1) through acoustic signal synthesis. The client 204 completes the smart caching and production of the acoustic signal of the text to speech system 100 (FIG. 1).

A pronunciation database 218 of the server 202 stores at least one of three types of data used to determine pronunciation: letter-to-sound rules, including context-based rules and pronunciation predictions for unknown words; statistical models, which convert letter sequences to most probable phoneme sequences based on language statistics; and dictionaries, which contain exceptions that cannot be derived from rules or statistical methods. A prosody database 220 of the server 202 contains rule sets or statistical models that determine phoneme durations and pitch based on the word and its context. An acoustic unit database 222 stores sub-phonetic, phonetic, and larger multi-phonetic acoustic units that are selected to obtain the desired phonemes.

The server 202 performs text normalization, pronunciation, prosody generation, and acoustic signal synthesis using the pronunciation database 218, the prosody database 220, and the acoustic unit database 222. In an embodiment the databases may be combined, separated, or additional databases may be used. After the acoustic signal that imitates natural speech has been synthesized, the acoustic signal is stored in storage 224, for example a hard disk, of the server 202. In an embodiment, the acoustic signal may be compressed.

Thus, the server machine 202 converts text, for example a book, into synthesized natural speech. The server machine 202 stores the synthesized natural speech and, upon request, transmits the synthesized natural speech to one or more of the client machines 204. The server machine 202 may store many book conversions.

The client machine 204 receives the acoustic signal through the client transfer module 216 from the server transfer module 214. The acoustic signal is stored in cache memory 226 of the client machine 204. When a user requests to listen to a book, the client machine 204 retrieves the acoustic signal from the cache memory 226 and produces the acoustic signal imitating natural speech through a speech output unit 228, for example a speaker. In some embodiments, a reader application narrates the acoustic signal for the book.

In an embodiment, the server 202 may store acoustic signals of recently played audio-converted books in storage 224. In other embodiments, the client 204 may store recently played audio-converted books in the cache memory 226. In some embodiments, the server 202 pre-converts newly added books into audio format. For example, books that a user has recently purchased, books that have been newly released, or books that are newly available for audio conversion.

In an embodiment, the server 202 may have a list of audio-converted books that are grouped together based on various criteria. For example, the criteria may include theme, genre, title, author, dates, books previously read by the user, books previously read by other users, user demographic information, etc. In some embodiments the groups are lists of books that may include one or more books on the client 204. The audio-converted books may be downloaded to the client 204, or the audio-converted books may stream directly to the client 204. In various embodiments, the server 202 or the client 204 may make smart guesses as to which book the user may read next, based on the criteria. In further embodiments, the client 204 may pre-cache a playlist of books put together by the user or other users.

Figure 3:
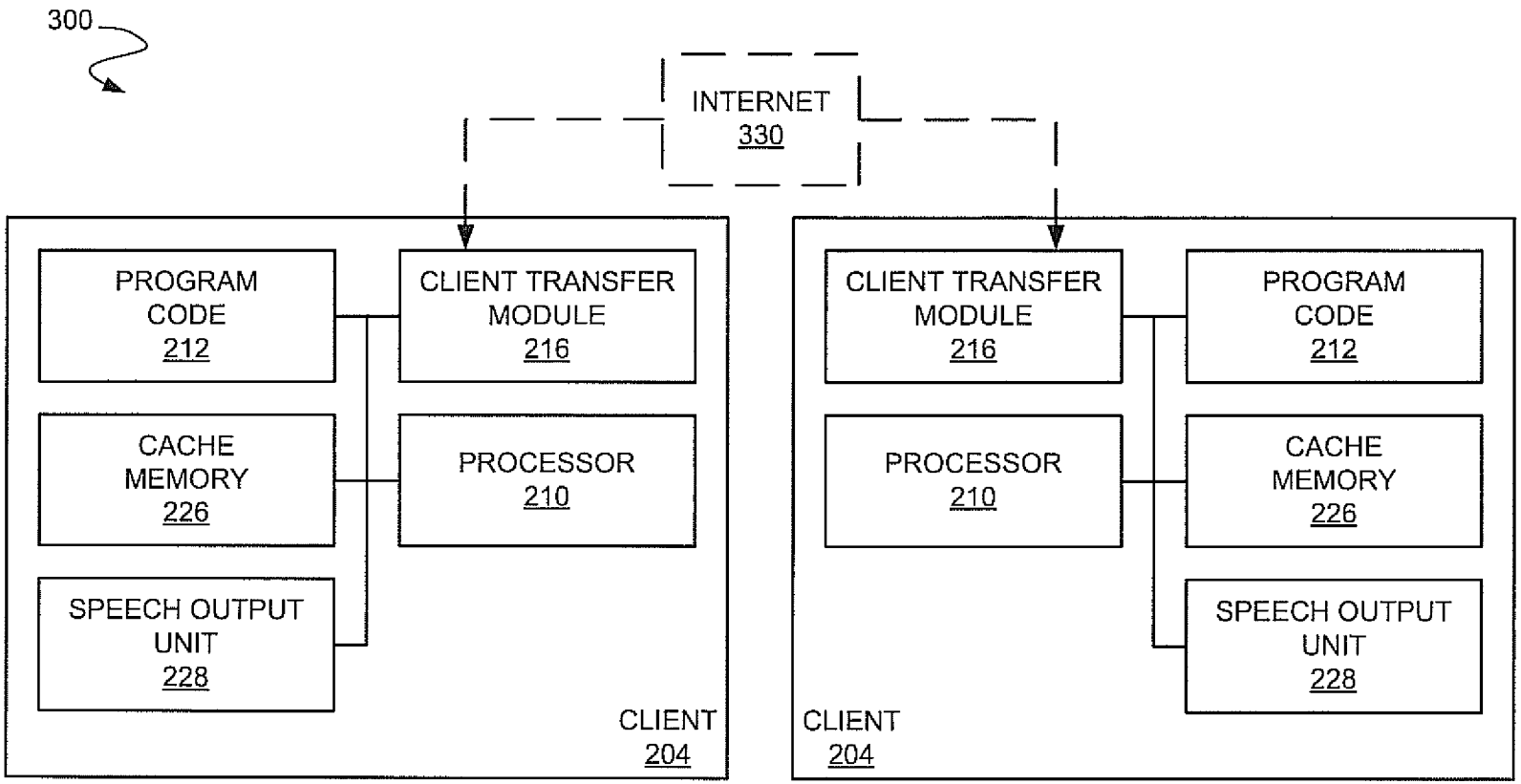
FIG. 3 is a diagram of an exemplary client-client system, according to an embodiment of the present invention.

FIG. 3 is a diagram of an exemplary client-client system 300, according to an embodiment of the present invention. The client-client system 300 transfers acoustic signals, representing speech that has already been converted, over the internet between client machines 204. The client machines 204 transmit and receive acoustic signals through client transfer modules 216 over the internet 330, for instance. The acoustic signals are stored in cache memories 226 of the client machines 204. When a user requests to listen to a book from one of the client machines 204, the corresponding client machine 204 retrieves the acoustic signal from the cache memory 226 and produces the acoustic signal imitating natural speech through a speech output unit 228, for example a speaker.

In an embodiment, the client machines 204 may store acoustic signals of recently played audio-converted books in the cache memories 226. In some embodiments, the clients 204 may have lists of audio-converted books that are grouped together based on various criteria. For example, the criteria may include theme, genre, title, author, dates, books previously read by the user, books previously read by other users, user demographic information, etc. In some embodiments the groups are lists of books that may include one or more books on the clients 204. The audio-converted books may be downloaded between the clients 204 over the internet, or the audio-converted books may stream between the clients 204 over the internet. In various embodiments, the clients 204 may make smart guesses as to which book the user may read next, based on the criteria. In further embodiments, the clients 204 may pre-cache a playlist of books put together by the user or other users.

Figure 4:
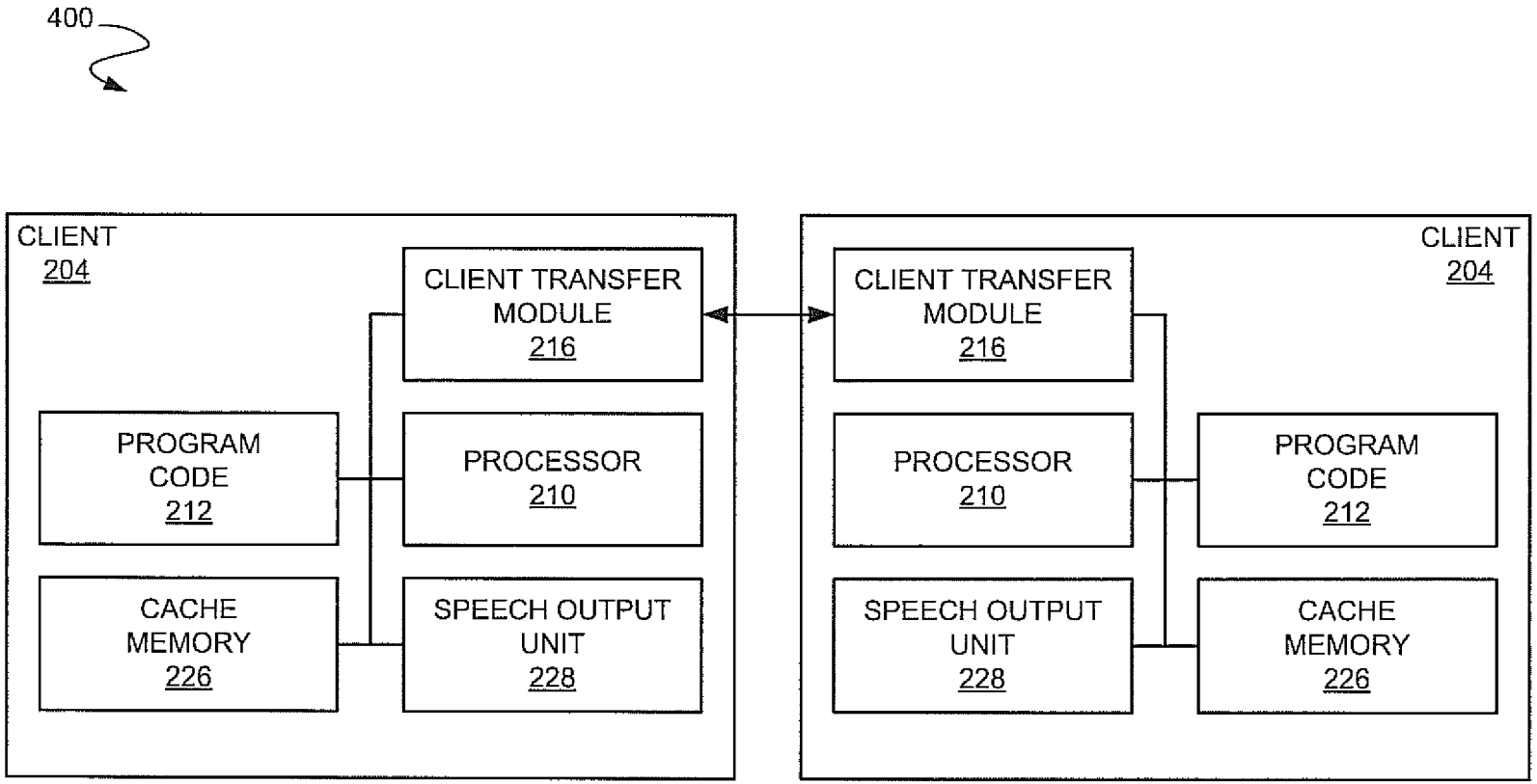
FIG. 4 is a diagram of an exemplary client-client system, according to an embodiment of the present invention.

FIG. 4 is a diagram of an exemplary client-client system 400, according to another embodiment of the present invention. The client-client system 400 transfers acoustic signals, representing text that has already been converted, directly between client machines 204. The client machines 204 transmit and receive acoustic signals through client transfer modules 216 directly between each other. For example, the client machines may communicate directly by any number of well known techniques, e.g. Wi-Fi, infrared, USB, FireWire, SCSI, Ethernet, etc. The acoustic signals are stored in cache memories 226 of the client machines 204. When a user requests to listen to a book from one of the client machines 204, the corresponding client machine 204 retrieves the acoustic signal from the cache memory 226 and produces the acoustic signal imitating natural speech through a speech output unit 228, for example a speaker.

In an embodiment, the client machines 204 may store acoustic signals of recently played audio-converted books in the cache memories 226. In some embodiments, the clients 204 may have lists of audio-converted books that are grouped together based on various criteria. For example, the criteria may include theme, genre, title, author, dates, books previously read by the user, books previously read by other users, user demographic information, etc. In some embodiments the groups are lists of books that may include one or more books on the clients 204. The audio-converted books may be transferred directly between the clients 204, or the audio-converted books may stream between the clients 204. In various embodiments, the clients 204 may make smart guesses as to which book the user may read next, based on the criteria. In further embodiments, the clients 204 may pre-cache a playlist of books put together by the user or other users.

Figure 5:
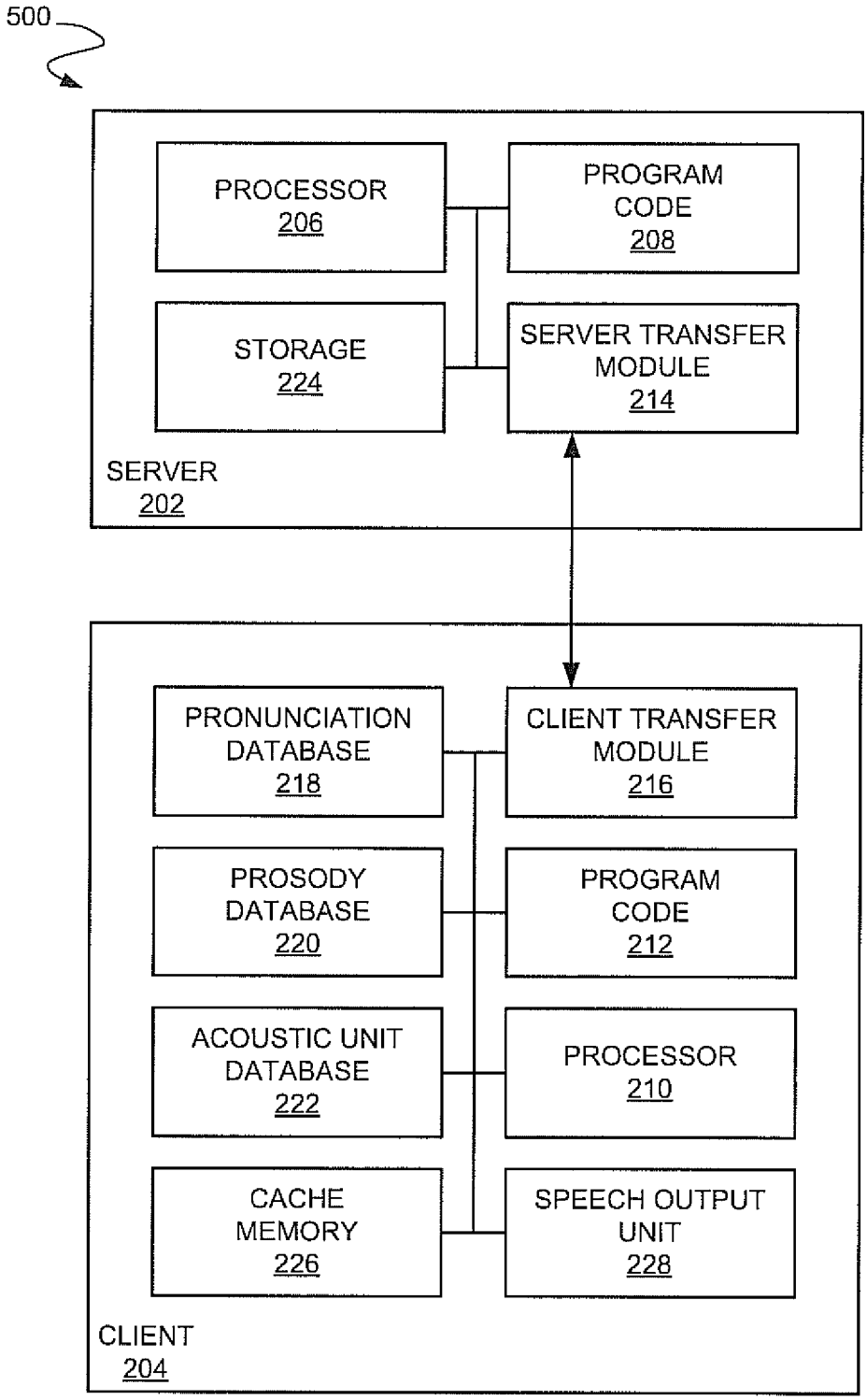
FIG. 5 is a diagram of an exemplary server-client system, according to an embodiment of the present invention.

FIG. 5 is a diagram of an exemplary server-client system 500, according to an embodiment of the present invention. The server-client system 500 converts text into speech on a client machine 204, uses smart caching techniques to prepare the converted text for output, stores the converted text on a server machine 202, and distributes the converted text from the server machine 202 to the client machine 204 for output. In an embodiment, the client machine 204 is a portable digital reader but could be any computer system. The server machine 202 and the client machine 204 may communicate when the client machine is connected to a power source or when the client machine is running on battery power. In an embodiment, the server machine 202 and the client machine 204 communicate by protocols such as XML, HTTP, TCP/IP, etc. The server-client system 500 may include multiple servers and multiple client machines that are connected over the internet or a local area network.

Server processor 206 of the server 202 operates under the direction of server program code 208. Client processor 210 of the client 204 operates under the direction of client program code 212. A server transfer module 214 of the server 202 and a client transfer module 216 of the client 204 communicate with each other. In an embodiment, the client 204 completes all of the steps of the text to speech system 100 (FIG. 1). The server 202 stores a large library of acoustic signals representing audio converted books.

Thus, the client machine 204 converts text, for example a book, into synthesized natural speech using a pronunciation database 218, a prosody database 220, and an acoustic unit database 222. The server machine 202 stores the synthesized natural speech and, upon request, transmits the synthesized natural speech to one or more of the client machines 204. The server machine 202 may store many book conversions in storage 224.

The client machine 204 transmits/receives the acoustic signal through the client transfer module 216 to/from the server transfer module 214. The acoustic signal is stored in cache memory 226 of the client machine 204. When a user requests to listen to a book, the client machine 204 retrieves the acoustic signal from the cache memory 226 and produces the acoustic signal imitating natural speech through a speech output unit 228, for example a speaker.

In an embodiment, the server 202 may store acoustic signals of recently played audio-converted books in storage 224. In other embodiments, the client 204 may store recently played audio-converted books in the cache memory 226. In some embodiments, the client 204 pre-converts newly added books into audio format. For example, books that a user has recently purchased, books that have been newly released, or books that are newly available for audio conversion.

In an embodiment, the server 202 may have a list of audio-converted books that are grouped together based on various criteria. For example, the criteria may include theme, genre, title, author, dates, books previously read by the user, books previously read by other users, user demographic information, etc. In some embodiments the groups are lists of books that may include one or more books on the client 204. The audio-converted books may be downloaded to the client 204, or the audio-converted books may stream directly to the client 204. In various embodiments, the server 202 or the client 204 may make smart guesses as to which book the user may read next, based on the criteria. In further embodiments, the client 204 may pre-cache a playlist of books created by the user or other users.

Figure 6:
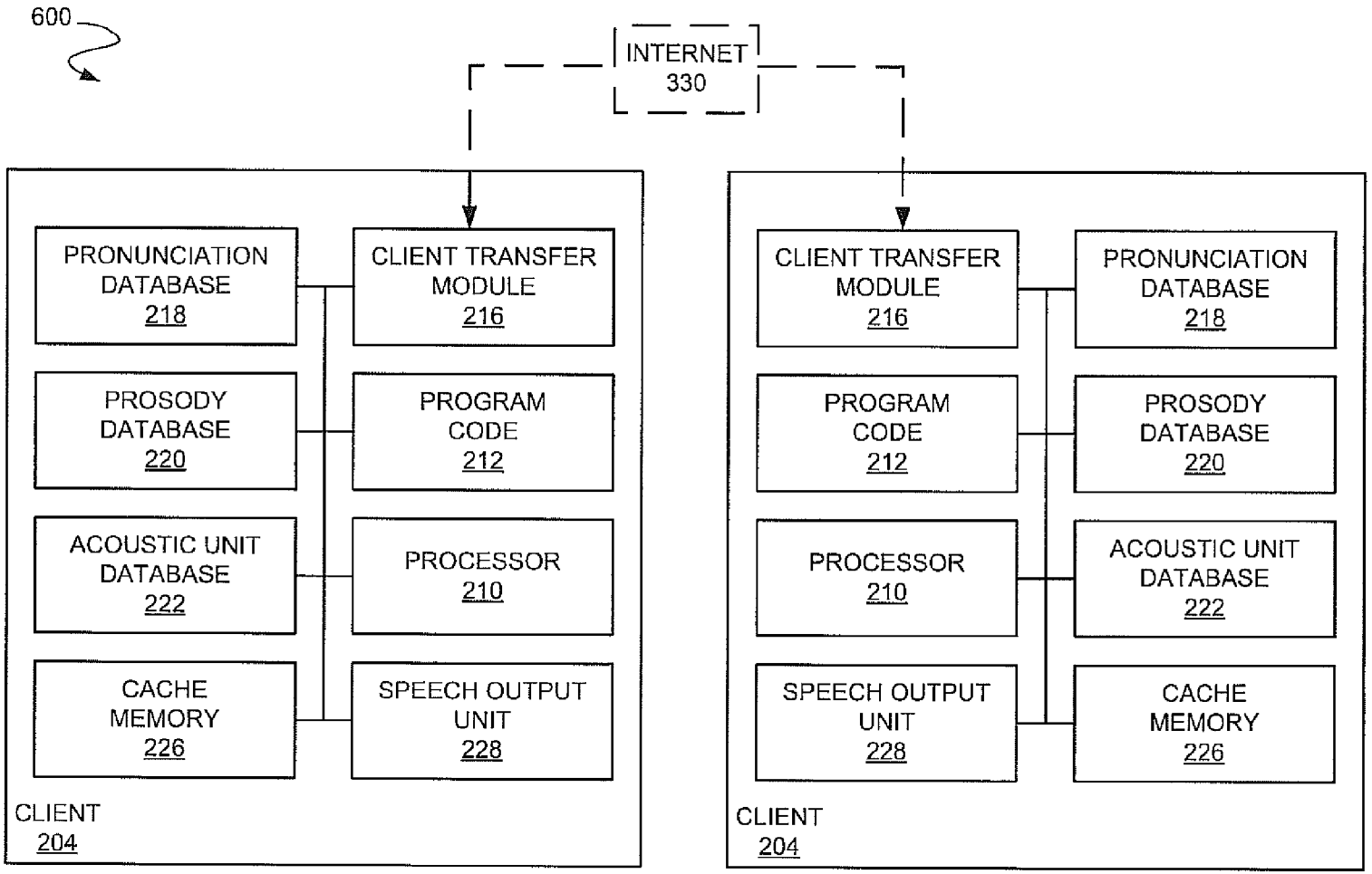
FIG. 6 is a diagram of an exemplary client-client system, according to an embodiment of the present invention.

FIG. 6 is a diagram of an exemplary client-client system 600, according to an embodiment of the present invention. The client-client system 600 converts text to speech on client machines 204 and transfers the converted speech between client machines over the internet. The client machines 204 convert text, for example a book, into synthesized natural speech using pronunciation databases 218, prosody databases 220, and acoustic unit databases 222. In an embodiment, the client machines 204 may work together to convert books. For example, various client machines 204 may convert different portions of a book.

Client machines 204 transmit and receive acoustic signals through client transfer modules 216 over the internet 330. The acoustic signals are stored in cache memories 226 of the client machines 204. When a user requests to listen to a book from one of the client machines 204, the corresponding client machine 204 retrieves the acoustic signal from the cache memory 226 and produces the acoustic signal imitating natural speech through a speech output unit 228, for example a speaker.

In an embodiment, the client machines 204 may store acoustic signals of recently played audio-converted books in the cache memories 226. In some embodiments, the clients 204 may have lists of audio-converted books that are grouped together based on various criteria. For example, the criteria may include theme, genre, title, author, dates, books previously read by the user, books previously read by other users, user demographic information, etc. In some embodiments the groups are lists of books that may include one or more books on the clients 204. The audio-converted books may be downloaded between the clients 204 over the internet, or the audio-converted books may stream between the clients 204 over the internet. In various embodiments, the clients 204 may make smart guesses as to which book the user may read next, based on the criteria. In further embodiments, the clients 204 may pre-cache a playlist of books created by the user or other users.

Figure 7:
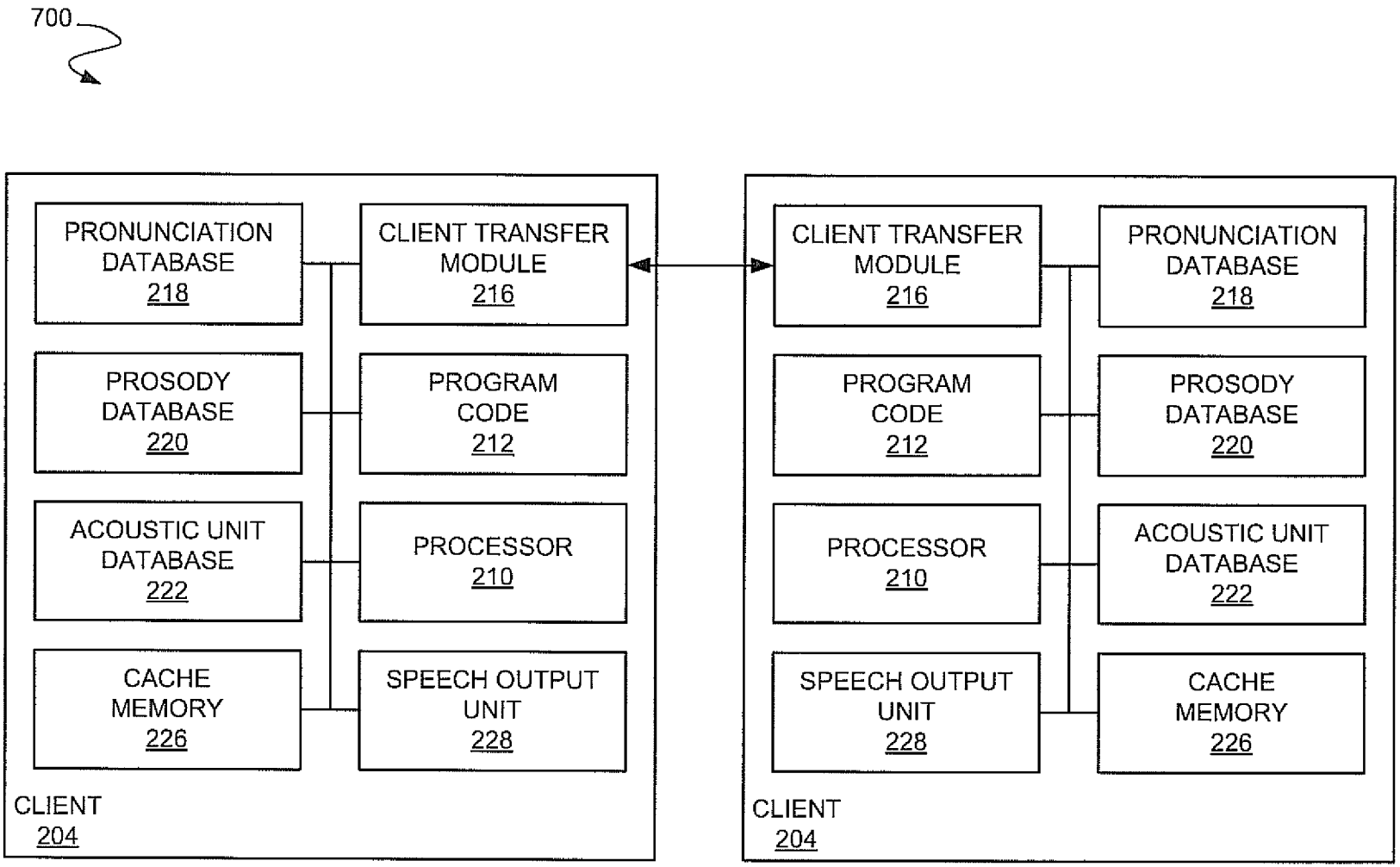
FIG. 7 is a diagram of an exemplary client-client system, according to an embodiment of the present invention.

FIG. 7 is a diagram of an exemplary client-client system 700, according to an embodiment of the present invention. The client-client system 600 converts text to speech on client machines 204 and transfers the converted speech directly between client machines. The client machines 204 convert text, for example a book, into synthesized natural speech using pronunciation databases 218, prosody databases 220, and acoustic unit databases 222. In an embodiment, the client machines 204 may work together to convert books. For example, various client machines 204 may convert different portions of a book.

Client machines 204 transmit and receive acoustic signals through client transfer modules 216 directly between each other. For example, the client machines may communicate directly by any number of well known techniques, e.g. Wi-Fi, infrared, USB, FireWire, SCSI, Ethernet, etc. The acoustic signals are stored in cache memories 226 of the client machines 204. When a user requests to listen to a book from one of the client machines 204, the corresponding client machine 204 retrieves the acoustic signal from the cache memory 226 and produces the acoustic signal imitating natural speech through a speech output unit 228, for example a speaker.

In an embodiment, the client machines 204 may store acoustic signals of recently played audio-converted books in the cache memories 226. In some embodiments, the clients 204 may have lists of audio-converted books that are grouped together based on various criteria. For example, the criteria may include theme, genre, title, author, dates, books previously read by the user, books previously read by other users, user demographic information, etc. In some embodiments the groups are lists of books that may include one or more books on the clients 204. The audio-converted books may be transferred directly between the clients 204, or the audio-converted books may stream between the clients 204. In various embodiments, the clients 204 may make smart guesses as to which book the user may read next, based on the criteria. In further embodiments, the clients 204 may pre-cache a playlist of books created by the user or other users.

Figure 8:
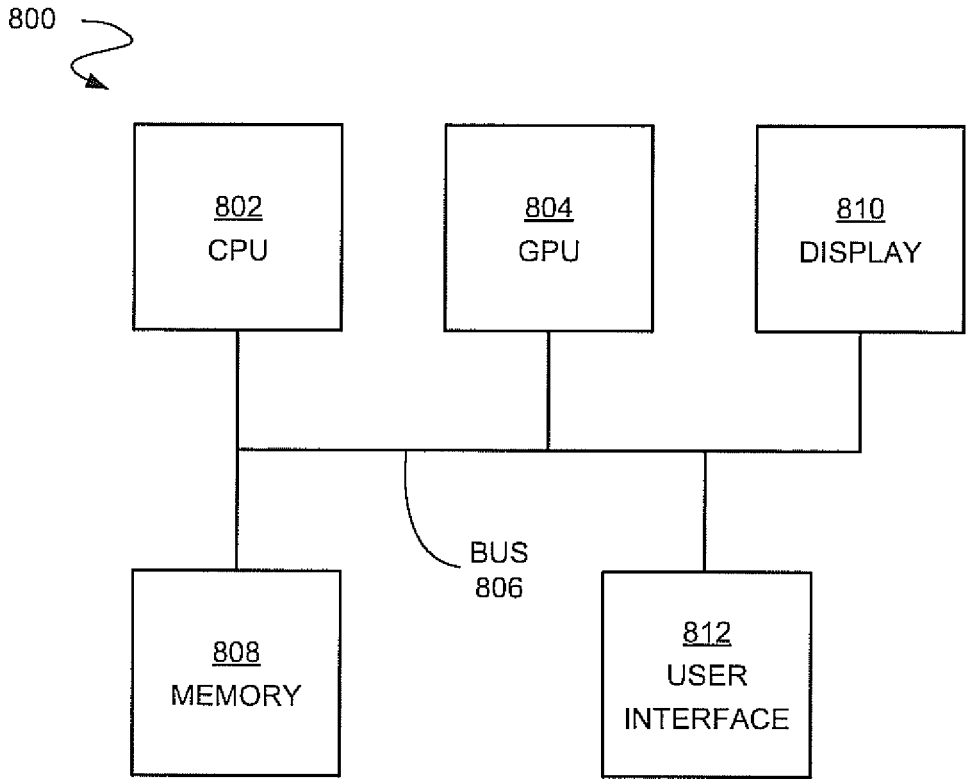
FIG. 8 is a block diagram of an example of a general purpose computer system within which a text to speech system in accordance with the present invention can be implemented.

FIG. 8 is a block diagram of an example of a general purpose computer system 800 within which a text to speech system in accordance with the present invention can be implemented. In the example of FIG. 8, the system includes a host central processing unit (CPU) 802 coupled to a graphics processing unit (GPU) 804 via a bus 806. One or more CPUs as well as one or more GPUs may be used.

Both the CPU 802 and the GPU 804 are coupled to memory 808. In the example of FIG. 8, the memory 808 may be a shared memory, whereby the memory stores instructions and data for both the CPU 802 and the GPU 804. Alternatively, there may be separate memories dedicated to the CPU 802 and GPU 804, respectively. In an embodiment, the memory 808 includes the text to speech system in accordance with the present invention. The memory 808 can also include a video frame buffer for storing pixel data that drives a coupled display 810.

The system 800 also includes a user interface 812 that, in one implementation, includes an on-screen cursor control device. The user interface may include a keyboard, a mouse, a joystick, game controller, and/or a touch screen device (a touchpad).

Generally speaking, the system 800 includes the basic components of a computer system platform that implements functionality in accordance with embodiments of the present invention. The system 800 can be implemented as, for example, any of a number of different types of computer systems (e.g., servers, laptops, desktops, notebooks, and gaming systems), as well as a home entertainment system (e.g., a DVD player) such as a set-top box or digital television, or a portable or handheld electronic device (e.g., a portable phone, personal digital assistant, handheld gaming device, or digital reader).

Figure 9:
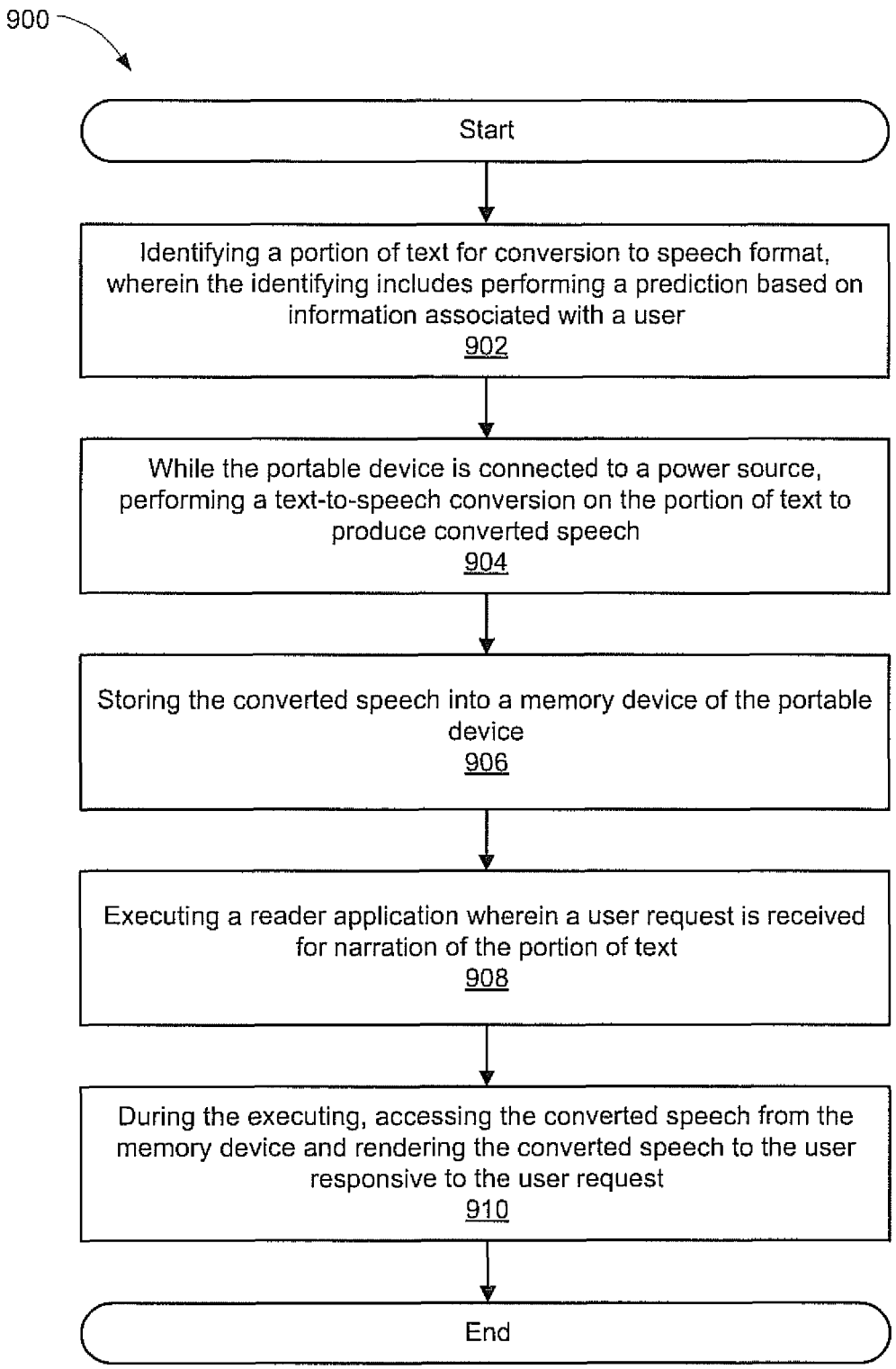
FIG. 9 depicts a flowchart of an exemplary method of text to speech conversion, according to an embodiment of the present invention.

FIG. 9 depicts a flowchart 900 of an exemplary computer controlled method of efficient text to speech conversion according to an embodiment of the present invention. Although specific steps are disclosed in the flowchart 900, such steps are exemplary. That is, embodiments of the present invention are well-suited to performing various other steps or variations of the steps recited in the flowchart 900.

In a step 902, portions of text are identified for conversion to speech format, wherein the identifying includes performing a prediction based on information associated with a user. In an embodiment, the portions of text include audio-converted books. For example, in FIG. 2 books are converted to synthesized natural speech, and smart caching techniques anticipate future books the user may request.

In some embodiments, the information includes identifications of newly added books, and the portion of text is taken from the newly added book. For example, in FIG. 2 a server identifies books that a user has recently purchased, books that have been newly released, or books that are newly available for audio conversion. The server may convert the books into audio format and transmit the audio format to the client, in anticipation of the user requesting the book.

In various embodiments, the text includes an audio-converted book, and the performing a prediction includes anticipating a succeeding book based on features of the audio-converted book. For example, in FIG. 2 predictions may be based on criteria including theme, genre, title, author, dates, books previously read by the user, books previously read by other users, user demographic information, etc. In addition, the information may include a user created playlist of books and/or a playlist of books that is created by other users with similar attributes to the user.

In a step 904, a text to speech conversion is performed on the portion of text to produce converted speech, while the portable device is connected to a power source. For example, in FIG. 2 the server converts books into synthesized natural speech. The converted book is transmitted book to the client while the client is connected to a power source.

In a step 906, the converted speech is stored into a memory device of the portable device. For example, in FIG. 2 the acoustic signal is stored in the cache memory of the client machine. In a step 908, a reader application is executed, wherein a user request is received for narration of the portion of text. For example, in FIG. 2 a user requests to listen to a book from the client machine. When the client machine receives the request, a reader application on the client machine narrates the audio converted book. In a step 910, during the executing, the converted speech is accessed from the memory device, and the converted speech is rendered on the portable device, responsive to the user request. For example, in FIG. 2 the acoustic signal is accessed from the cache memory of the client machine. The acoustic signal is played by the reader application through the speech output unit, a speaker.

Figure 10:
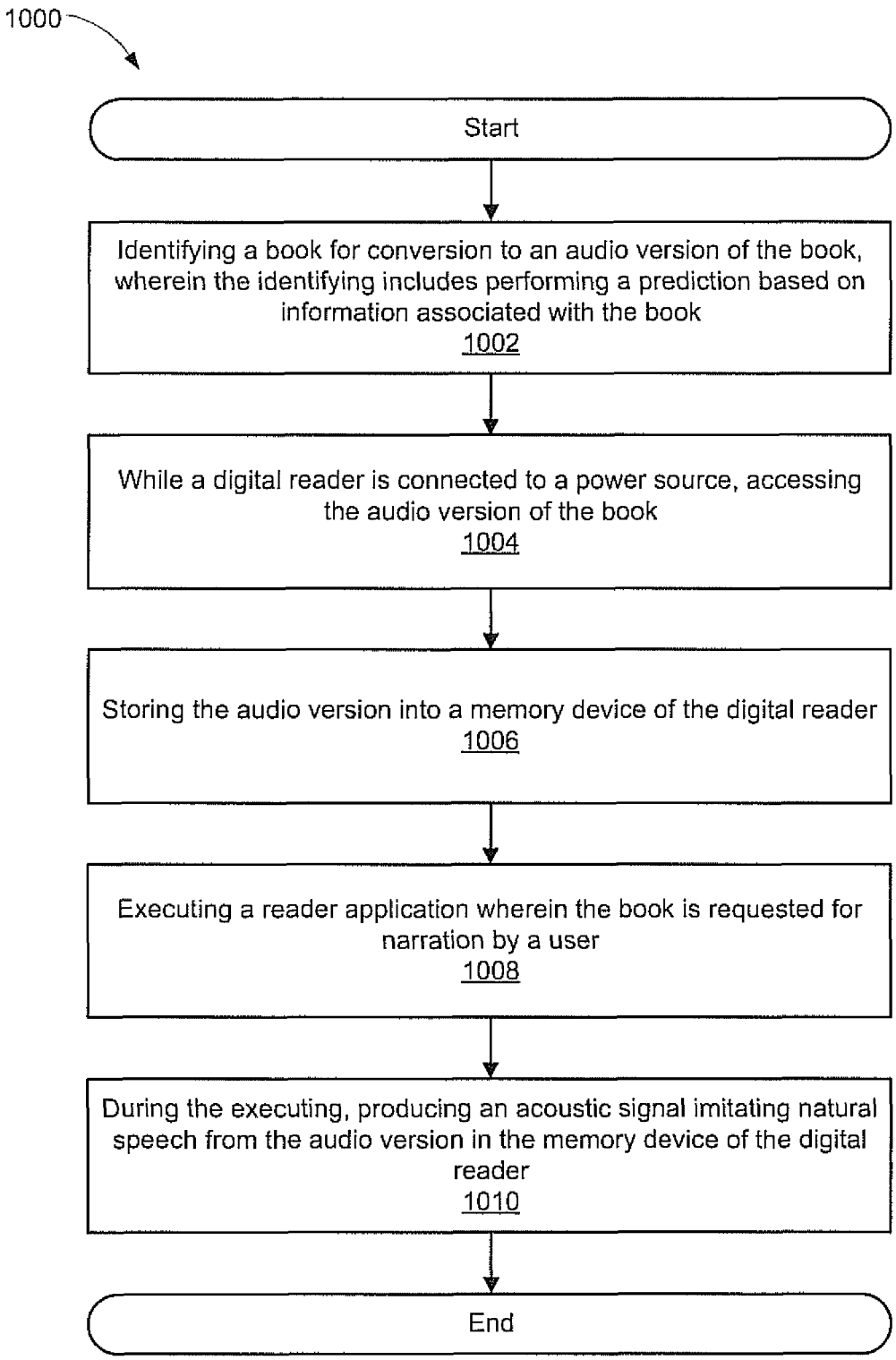
FIG. 10 depicts a flowchart of another exemplary method of text to speech conversion, according to an embodiment of the present invention.

FIG. 10 depicts a flowchart 1000 of an exemplary computer controlled method of text to speech conversion according to an embodiment of the present invention. Although specific steps are disclosed in the flowchart 1000, such steps are exemplary. That is, embodiments of the present invention are well-suited to performing various other steps or variations of the steps recited in the flowchart 1000.

In a step 1002, a book is identified for conversion to an audio version of the book, wherein the identifying includes performing a prediction based on information associated with the book. In an embodiment, the information includes a list of books stored on a server, wherein the list of books includes an identification of the book. For example, in FIG. 2 the server stores lists of books and audio converted books. Audio converted books on the client machine may be included in one or more lists on the server. In some embodiments, the information includes theme, genre, title author, and date of the book.

In a step 1004, the audio version of the book is accessed while the digital reader is connected to a power source. In some embodiments, the accessing includes receiving a streaming communication over the internet from a server. For example, in FIG. 2 audio converted books may stream from the server to the client over the internet. In some embodiments, the accessing includes downloading the audio version over the internet from a server. For example, in FIG. 2 audio converted books may be downloaded to the client over the internet.

In various embodiments, the accessing includes downloading the audio version over the internet from another digital reader. For example, in FIG. 3 the client-client system transfers audio converted books from client to client over the internet. In further embodiments, the accessing includes downloading the audio version directly from another digital reader. For example, in FIG. 4 the client-client system may transfer audio converted books from client to client directly by Wi-Fi, infrared, USB, FireWire, SCSI, etc.

In a step 1006, the audio version is stored into a memory device of the digital reader. For example, in FIG. 2 the acoustic signal is stored in the cache memory of the client machine. In a step 1008, a reader application is executed, wherein to book is requested for narration by a user. For example, in FIG. 2 a user requests to listen to a book from the client machine. When the client machine receives the request, a reader application on the client machine narrates the audio converted book. In a step 1010, during the executing, an acoustic signal imitating natural speech is produced from the audio version in the memory device of the digital reader. For example, in FIG. 2 the acoustic signal is accessed from the cache memory of the client machine. The acoustic signal is played by the reader application through the speech output unit, a speaker.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as may be suited to the particular use contemplated.

What is claimed is:

1. A method of performing text to speech conversion on a portable device, said method comprising:

predicting, based at least in part on prior user selection of at least one second book and on a first book being newly released and prior to user selection of listening to an audio version of the first book, the first book being different from the second book, the first book for conversion to speech format, by anticipating the first book based on at least one feature of the first book, the at least one feature being new release of the first book;

responsive to the predicting and prior to user selection to listen to the audio version of the first book, performing a text to speech conversion on said book to produce converted speech;

storing said converted speech into a memory device of said portable device;

executing a reader application wherein a user request is received for narration of said book; and during said executing, accessing said converted speech from said memory device and rendering said converted speech on said portable device responsive to said user request.

2. The method of claim 1 wherein said at least one feature further comprises identifications of newly added books and wherein said first book is taken from said newly added books.

3. The method of claim 1 wherein said at least one feature further comprises a playlist of books.

4. The method of claim 3 wherein said playlist of books is user created.

5. The method of claim 3 wherein said playlist of books is created by other users with similar attributes to said user.

6. A system comprising:

a processor;

a display coupled to said processor;

an input device coupled to said processor;

an audio output device coupled to said processor;

memory coupled to said processor, wherein said memory comprises instructions that when executed cause said system to perform text to speech conversion, said method comprising:

prior to a user selection to play an audible version of a portion of text, predictively identifying the portion of text for conversion to speech format, wherein said identifying comprises performing a prediction based on information associated with a user's prior reading of at least one prior-read book and based on the portion of text being newly released for access, the prior-read book being different from the portion of text being newly released for access;

performing a text to speech conversion on said portion of text to produce converted speech;

storing said converted speech into a memory device of said portable device;

executing a reader application wherein a user request is received for narration of said portion of text; and during said executing, accessing said converted speech from said memory device and rendering said converted speech on said audio output device responsive to said user request.

7. The system of claim 6 wherein said portion of text comprises an audio-converted book.

8. The system of claim 6 wherein said information comprises identifications of newly added books and wherein said portion of text is taken from said newly added books.

9. The system of claim 6 wherein said text comprises an audio-converted book, and said performing a prediction comprises anticipating a succeeding book based on features of said audio-converted book.

10. The system of claim 6 wherein said information comprises a user created playlist of books.

11. The system of claim 6 wherein said information comprises a playlist of books that is created by other users with similar attributes to said user.

* * * * *